US005658849A

United States Patent [19]

Yamazaki et al.

[11] Patent Number: 5,658,849

[45] Date of Patent: Aug. 19, 1997

[54] THERMAL TRANSFER MATERIAL

[75] Inventors: Toshio Yamazaki; Shouji Ichinohe; Akira Yamamoto, all of Matsuida-machi; Satoshi Uchida, Kubiki-mura, all of Japan

[73] Assignee: Shin-Etsu Chemical Co., Ltd., Tokyo, Japan

[21] Appl. No.: 544,412

[22] Filed: Oct. 10, 1995

[30] Foreign Application Priority Data

Oct. 11, 1994 [JP] Japan ..... 6-272863

[51] Int. Cl.[6] ..... B41M 5/035; B41M 5/38

[52] U.S. Cl. ..... 503/227; 428/195; 428/423.1; 428/447; 428/484; 428/532; 428/913; 428/914

[58] Field of Search ..... 503/227; 428/195, 428/207, 484, 488.4, 488.1, 532, 533, 534, 447, 423.1

[56] References Cited

U.S. PATENT DOCUMENTS 4,925,735 5/1990 Koshizuka et al. ..... 428/423.1

*Primary Examiner*—Bruce H. Hess

*Attorney, Agent, or Firm*—Townsend & Banta

[57] ABSTRACT

A thermal transfer material comprises a film-form base on one side of which a thermal transfer pigment layer is provided wherein the other side of said film-form base has a back coating layer comprising a polysaccharide derivative (s) reacted with organopolysiloxane or a cured product thereof.

7 Claims, No Drawings

THERMAL TRANSFER MATERIAL

RELATED APPLICATION

This application claims the priority of Japanese Patent application No. 6-272863 filed on Oct. 1, 1994, which is incorporeted herein by reference.

BACKGROUND OF THE INVENTION

1. Field of the Invention

This invention relates in general to a thermal transfer material and more particularly to a thermal transfer material with an excellent back coating layer which keeps the base film from fusing to the thermal head.

2. The Prior Art

For thermal transfer materials, the sublimation type and the heat-melt type have been conventionally known. In the former case, a dye layer comprising a heat sublimation type dye(s) and a heat resistant binder resin(s) is provided on a base such as a polyester film and, by a thermal printing operation from its back side using a thermal head, heat sublimation type images are transferred onto an image forming layer provided on a transfer-receiving base such as paper. In the latter case, a pigment layer comprising a pigment(s) and/or a dye(s) and a heat-melting binder resin(s) is formed and heat-melting images are transferred by means of thermal printing. For such base films for thermal transfer materials, polyester and, for a general purposes, polyethylene terephthalate have been used. However, since they are thermo-plastic, sometimes the thermal head and the base film are fused during thermal printing and the operation becomes impossible.

To solve this problem, the addition of a back coating layer (a back smooth layer) was proposed and disclosed in Japanese unexamined patent publication Tokkai Sho 55-7467, Tokkai Sho 60-225777, Tokkai Sho 62-1575, Tokkai Hei 2-148395, Tokkai Hei 3-61087, Japanese examined patent publication Tokko Hei 4-17160, etc. However, although thermal transfer printers have been improved and their performance has been enhanced, there are problems regarding contamination and wear of the thermal heads. Particularly for the sublimation type, which requires several times more thermal energy than the heat-melt type, even now the heat resistance of the thermal transfer materials is not satisfactory. Even for the heat-melt type, an improvement in heat resistance is desired in response to high speed printing and diversified transfer-receiving bases.

On the other hand, Tokkai Hei 5-85070 proposes a back coating layer(s) comprising a resin(s) prepared by the graft-bonding of organopolysiloxane or a cured product thereof. It features superior heat resistance, film properties and slip properties. However, it does not simultaneously satisfy the heat resistance, slip properties and friction resistance requirements.

The conventional technology as described above uses a thermo-plastic resin for the base and insufficient slip properties and the occurrence of 5locking under harsh thermal transfer conditions have been observed. There is a method in which the resin becomes a cured product by cross-linking the hydroxyl groups and such for the purpose of improving heat resistance. However, even with this method, it is relatively difficult to prepare the resin to be cross-linked with a sufficient amount of hydroxyl groups.

BRIEF SUMMARY OF THE INVENTION

The object of the invention is to provide a new thermal transfer material which uses for the back coating layer a polysaccharide derivative(s) which has not been used in said conventional technology. That is, the object of the present invention is to provide a new thermal transfer material with an excellent back coating layer with superior heat resistance, film properties and slip properties which does not cause contamination or wear of the thermal head.

The invention provides a thermal transfer material comprising a film-form base on one side of which a thermal transfer pigment layer is provided wherein the other side of said film-form base has a back coating layer comprising a polysaccharide derivative(s) reacted with organopolysiloxane or a cured product thereof.

The organopolysiloxane may be represented by the following general formula (1):

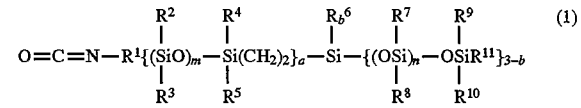

(1)

wherein $R^1$ denotes a divalent hydrocarbon group with 1 to 10 carbon atoms, $R^2$–$R^8$ denote monovalent hydrocarbon groups with 1 to 10 carbon atoms, $R^9$–$R^{11}$ denote monovalent hydrocarbon groups with 1 to 10 carbon atoms or triorganosiloxy groups represented by $—OSiR^{12}R^{13}R^{14}$ ($R^{12}$, $R^{13}$ and $R^{14}$ denote monovalent hydrocarbon groups with a carbon number of 1–10), "m" denotes an integer 0–5, "n" denotes a number 0–200, "a" denotes 0 or 1, and "b" denotes 0, 1 or 2.

The organopolysiloxane represented by the general formula (1) may be preferably represented by either of the following general formulas (2) to (4):

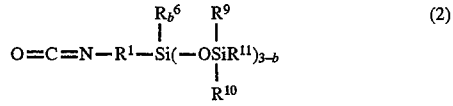

(2)

wherein $R^1$ denotes a divalent hydrocarbon group with 1 to 10 carbon atoms, $R^6$ denotes a monovalent hydrocarbon group with 1 to 10 carbon atoms, $R^9$–$R^{11}$ denote monovalent hydrocarbon groups with 1 to 10 carbon atoms or triorganosiloxy groups represented by $—OSiR^{12}R^{13}R^{14}$ ($R^{12}$, $R^{13}$ and $R^{14}$ denote monovalent hydrocarbon groups with 1 to 10 carbon atoms), and "b" denotes 0, 1 or 2, or:

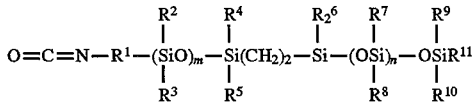

(3)

wherein $R^1$ denotes a divalent hydrocarbon group with 1 to 10 carbon atoms, $R^2$–$R^8$ denote monovalent hydrocarbon groups with a carbon number of 1–10, $R^9$–$R^{11}$ denote monovalent hydrocarbon groups with 1 to 10 carbon atoms or triorganosiloxy groups represented by $—OSiR^{12}R^{13}R^{14}$ ($R^{12}$, $R^{13}$ and $R^{14}$ denote monovalent hydrocarbon groups with 1 to 10 carbon atoms), "m" denotes an integer 0–5 and "n" denotes a number 0–200, or:

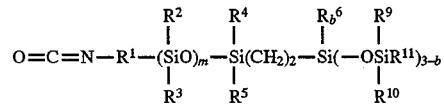

(4)

wherein $R^1$ denotes a divalent hydrocarbon group with a carbon number of 1–10, $R^2$–$R^8$ denote monovalent hydrocarbon groups with 1 to 10 carbon atoms, denote monovalent hydrocarbon groups with 1 to 10 carbon atoms or triorganosiloxy groups represented by $—OSiR^{12}R^{13}R^{14}$ ($R^{12}$, $R^{13}$ and $R^{14}$ denote monovalent hydrocarbon groups with 1 to 10 carbon atoms), "m" denotes an integer 0–5, and "b" denotes 0, 1 or 2.

The polysaccharide derivative(s) may be one type or a mixture of more than one type chosen from among cellulose derivatives, starch, dextrine and pullulan The cellulose derivative may be chosen from among methyl cellulose, ethyl cellulose, hydroxypropylmethyl cellulose, hydroxypropyl cellulose, hydroxyethyl cellulose, hydroxyethylmethyl cellulose, acetyl cellulose and acetyl cellulose butyrate.

The cured product may be a cured product prepared by cross-linking a polysaccharide derivative(s) by using polyisocyanate.

DETAILED DESCRIPTION

The present invention is described in detail below.

(Film-form base)

The film-form base for a thermal transfer material should preferably have a certain degree of heat resistance and strength and also highly stable dimensions. For example, regular paper, processed paper including coated paper and laminated paper, and resin films including polyester, polystyrene, polyolefin, polyamide, polysulfon, polycarbonate and polyvinyl alcohol are preferably used. Particularly preferable is a polyethylene terephthalate film. The thickness of the film-form base is 50 micrometers or less, preferably in the range of 3–10 micrometers. The shape of the film-form base is not limited in particular. The continuous type such as rolls is often used, but separate sheets can also be used.

(Back coating layer)

The back coating layer provided on the other side of said film-form base comprises a polysaccharide derivative(s) reacted with organopolysiloxane or a cured product thereof.

The organopolysiloxane is more preferably one represented by the following chemical formula (5):

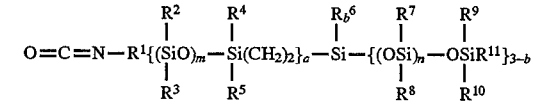

(5)

wherein $R^1$ denotes a divalent hydrocarbon group with a carbon number of 1–10, $R^2$–$R^8$ denote monovalent hydrocarbon groups with 1 to 10 carbon atoms, $R^9$–$R^{11}$ denote monovalent hydrocarbon groups with 1 to 10 carbon atoms or triorganosiloxy groups represented by —$OSiR^{12}R^{13}R^{14}$ ($R^{12}$, $R^{13}$ and $R^{14}$ denote monovalent hydrocarbon groups with 1 to 10 carbon atoms), "m" denotes an integer 0–5, "n" denotes a number 0–200 and preferably denotes 0–80, "a" denotes 0 or 1, and "b" denotes 0, 1 or 2.

R' denotes an alkylene group such as a methylene, ethylene, propylene or butylene group, and preferably denotes an alkylene group with 1 to 6 carbon atoms, and more preferably denotes a propylene group.

Any of $R^2$–$R^{14}$ denotes an alkyl group such as a methyl, ethyl, propyl or butyl group, a cycloalkyl group such as a cyclopentyl or cyclohexyl group, an aryl group such as a phenyl group, an aralkyl group such as a benzyl group, an alkenyl group such as a vinyl or allyl group, or a substituted hydrocabon group such as a chloromethyl, 3,3,3-trifluoropropyl or 2-cyanoethyl group, and preferably denotes an alkyl group with 1 to 4 carbon atoms.

The aforementioned organopolysiloxane represented by the chemical formula (5) is more preferably selected from ones represented by the following chemical formulas (6) to (8):

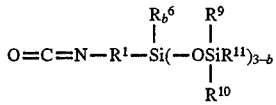

(6)

wherein $R^1$ denotes a divalent hydrocarbon group with 1 to 10 carbon atoms, $R^6$ denotes a monovalent hydrocarbon group with 1 to 10 carbon atoms, $R^9$–$R^{11}$ denote monovalent hydrocarbon groups with 1 to 10 carbon atoms or triorganosiloxy groups represented by —$OSiR^{12}R^{13}R^{14}$ ($R^{12}$, $R^{13}$ and $R^{14}$ denote monovalent hydrocarbon groups with 1 to 10 carbon atoms), and "b" denotes 0, 1 or 2, or:

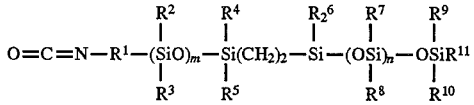

(7)

wherein $R^1$ denotes a divalent hydrocarbon group with 1 to 10 carbon atoms, $R^2$–$R^8$ denote monovalent hydrocarbon groups with 1 to 10 carbon atoms, $R^9$–$R^{11}$ denote monovalent hydrocarbon groups with 1 to 10 carbon atoms or triorganosiloxy groups represented by —$OSiR^{12}R^{13}R^{14}$ ($R^{12}$, $R^{13}$ and $R^{14}$ denote monovalent hydrocarbon groups with 1 to 10 carbon atoms), "m" denotes an integer 0–5 and "n" denotes a number 0–200, or:

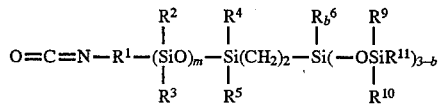

(8)

wherein $R^1$ denotes a divalent hydrocarbon group with 1 to 10 carbon atoms, $R^2$–$R^8$ denote monovalent hydrocarbon groups with 1 to 10 carbon atoms, $R^9$–$R^{11}$ denote monovalent hydrocarbon groups with 1 to 10 carbon atoms or triorganosiloxy groups represented by —$OSiR^{12}R^{13}R^{14}$ ($R^{12}$, $R^{13}$ and $R^{14}$ denote monovalent hydrocarbon groups with 1 to 10 carbon atoms), "m" denotes an integer 0–5, and "b" denotes 0, 1 or 2.

The aforementioned organopolysiloxane represented by the chemical formula (7) is further more preferably one represented by the chemical formula (9):

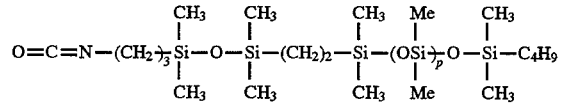

(9)

wherein "p" denotes an integer 10–60.

As mentioned earlier, Tokkai Hei 5-85070 proposes back coating layers comprising a resin(s) prepared by the graft-bonding of organopolysiloxane or a cured product thereof, and these back coating layers feature superior heat resistance, film properties and slip properties. However, since all of these use a thermo-plastic resin as the base, insufficient slip properties and the occurrence of blocking under harsh thermal transfer conditions have been observed. The inventors have come to propose a polysaccharide derivative(s) reacted with organopolysiloxane or a cured product thereof, represented by the general formula shown above, to be used as a back coating layer which has, compared with any resin disclosed in said patent publications, comparable heat resistance and coating properties and superior slip properties and does not cause contamination or wear of the thermal head. The present invention allows a high ratio of modified siloxane while leaving enough hydroxyl groups which are necessary for isocyanate cross-linking.

Examples of the polysaccharide derivative include one type or a mixture of more than one type chosen from among cellulose derivatives including methyl cellulose, ethyl cellulose, hydroxypropylmethyl cellulose, hydroxypropyl cellulose, hydroxyethyl cellulose, hydroxyethylmethyl cellulose, acetyl cellulose and acetyl cellulose butyrate, starch, dextrine and pullulans. Of these, particularly preferable are ethyl cellulose, hydroxypropylmethyl cellulose, hydroxyethylmethyl cellulose and acetyl cellulose.

The method of reacting these polysaccharide derivatives with organopolysiloxane is not limited in particular. For example, the method disclosed in Tokkai Hei 6-145201 can be used. This method can control the ratio of modified silicones in the organopolysiloxane according to the characteristics desired of the back coating layer. The ratio of modified silicones in the organopolysiloxane is preferably 1–90%, and more preferably 20–80%. If the ratio of modified silicones in the organopolysiloxane is too small, then the smoothness is insufficient. If it is too large, then film properties tend to be reduced.

In the present invention, it is desirable to cure the back coating layer by cross-linking using polyisocyanate for the purpose of giving it heat resistance, coating properties and adhesion to the base film. Selection of this polyisocyanate is not limited as long as there are 2 or more isocyanate groups per molecule, and those commercially available under the name of Colonate (from Nippon Polyurethane Co., Ltd.), Takenate (from Takeda Chemical Industries, Ltd.), Desmodule (Bayer Co., Ltd.), etc. can be used.

The amount of the added polyisocyanate is preferably 5–200 weight parts, more preferably 50–200 weight parts and further more preferably 100–200 weight parts, for 100 weight parts of the polysaccharide derivative graft-bonded with organopolysiloxane. Excess or unreacted isocyanate groups can be deactivated by reacting with amine or alcohol, or they can be left as they are since they will not cause problems. If the amount of the added polyisocyanate is too small, then the cross-link density becomes low, resulting in insufficient heat resistance. If it is too large, then there will be problems such as a larger degree of shrinking of the formed coating film and a longer curing time.

In the present invention, when forming the back coating layer out of the materials described above, lubricants such as amides of higher fatty acids, esters of higher fatty acids, fine silica powder, fluoro resin powder and alkylphosphoric esters, antistatic agents such as surfactants, and conductive agents such as carbon black can be added for improved smoothness.

Prior art methods can be used to form the back coating layer. Conventional application and drying processes are sufficient and no special technique is necessary. When adding polyisocyanate to obtain a cured product, it is desirable to conduct a heat treatment after the drying process. The thickness of the back coating layer is preferably 0.1–10 micrometers. If it is too thin then its functionality as the back coating layer will be insufficient. If it is too thick, then heat conduction will be impeded.

(Thermal transfer pigment layer)

It is sufficient if the thermal transfer pigment layer on the other side of the film-form base contains a heat-sublimation type dye, for the sublimation type, or a pigment or a dye, for the heat-melt type. For the heat-sublimation type dye, dispersion dyes are desirable, examples of which include MS Yellow 32, MS Red 28, MS Blue 50 (Mitsui Toatsu Senryo Co., Ltd.), Kaseyatt Yellow A-G, Kaseyatt Red B and Kaseyatt Blue FR (Nippon Kayaku Co., Ltd.). As for the heat-melt type, examples of the pigment include inorganic pigments such as titania, carbon black, zinc oxide, cadmium sulfide and iron oxide, and organic pigments such as azo type, anthraquinone type and phthalocyanine type, and examples of the dye include acidic dyes, direct dyes and dispersion dyes. The binder resin for the sublimation type is chosen from among those which are heat resistant and do not impede the transfer of the dye from the dye layer to the image forming layer when heated, such as cellulose resin and vinyl resin. For the heat-melt type, it is a general practice to use a thermo-plastic resin with a softening point of 50°–150° C., such as polyolefin resin and acrylic resin and rubber, in combination with a wax with a melting point of 50°–100° C.

As is the case in said back coating layer, various prior art additives can be added to the thermal transfer pigment layer, and prior art methods can be used to form this layer. The thickness of the thermal transfer layer is preferably 0.2–5 micrometers for the sublimation type and 0.5–8 micrometers for the heat-melt type.

Examples

Examples of the present invention are described in detail below. The present invention is not limited to these examples. In the following description, "parts" and "%" are based on weight unless specified otherwise, and, except for solvents, they are in solid equivalent.

(Reference Example 1)

10 g of hydroxypropylmethyl cellulose with 1.12 hydroxyl groups, 1.88 methoxyl groups and 0.26 hydroxypropoxy groups per glucose unit, dried for 2 hours at 105° C., was dissolved in 100 ml of dimethylformamide, and heated to 80° C. while being stirred. 14 g of tristrimethylsiloxysilylpropyl isocyanate was added to this mixture and 2 hours of stirring at 100° C. was conducted to complete the reaction. After a reprecipitation operation on the reaction solution with 200 ml of water, the precipitate was separated by filtering, repeatedly rinsed with water and then dried to obtain 23 g of silicone modified hydroxypropylmethyl cellulose (silicone content 43.9%).

(Reference Example 2)

Using the same process as Reference example 1, except for the fact that 100 g of acetyl cellulose with 0.96 hydroxyl groups and 2.04 acetyl groups per glucose unit is used instead of hydroxypropyl cellulose and the amount of tristrimethylsiloxysilylpropyl isocyanate was 13 g, 21 g of silicone modified hydroxypropylmethyl cellulose (silicone content 40.8%) was obtained.

(Example 1)

Using a gravure coater, application solution A with the following ingredients was applied on a 4.5 micrometer-thick polyethylene terephthalate film such that the thickness after drying would be 1 micrometer, and dried (10 minutes at room temperature and 1 minute at 100° C.) to form a heat sublimation type dye layer.

| Application solution A: Heat sublimation type dye layer | |
|---|---|
| Blue dispersion dye (MS Blue 50 from Mitsui Toatsu Senryo Co., Ltd.) | 62.5 parts |
| Acetal resin (Esrec KS-5 from Sekisui Chemical Co., Ltd.) | 37.5 parts |
| Solvent (methyl ethyl ketone/toluene = 1/3) | |
| Adjusted to a solid-content of 10% | |

Using a bar coater #5, application solution B with the following ingredients was applied on the other side of the film described above such that the thickness after drying would be 2 micrometers, and dried (10 minutes at room temperature and 1 minute at 100° C.), followed by a heat treatment at 60° C. for 48 hours, to form a back coating layer and thus obtain a thermal transfer material.

| Application solution B: Back coating layer | |
|---|---|
| Silicone modified hydroxypropylmethyl cellulose of Reference example 1 | 47.5 parts |
| Polyisocyanate (Desmodule HL from Bayer Co., Ltd.) | 52.5 parts |
| Solvent (methyl ethyl ketone/toluene = 1/1) | |
| Adjusted to a solid-content of 5% | |

(Example 2)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 1 | 45.1 parts |
| Polyisocyanate (Desmodule HL from Bayer Co., Ltd.) | 49.9 parts |
| Amide of higher fatty acid (Famin D86 from Kao Corporation) | 5.0 parts |
| Solvent (methyl ethyl ketone/toluene = 1/1) | |
| Adjusted to a solid-content of 5% | |

(Example 3)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 1 | 40.4 parts |
| Polyisocyanate (Desmodule HL from Bayer Co., Ltd.) | 44.6 parts |
| Amide of higher fatty acid (Famin D86 from Kao Corporation) | 15.0 parts |
| Solvent (methyl ethyl ketone/toluene = 1/1) | |
| Adjusted to a solid-content of 5% | |

(Example 4)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 1 | 37.6 parts |
| Polyisocyanate (Desmodule HL from Bayer Co., Ltd.) | 62.4 parts |
| Solvent (methyl ethyl ketone/toluene = 1/1) | |
| Adjusted to a solid-content of 5% | |

(Example 5)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 1 | 95.0 parts |
| Amide of higher fatty acid (Famin D86 from Kao Corporation) | 5.0 parts |
| Solvent (methyl ethyl ketone/toluene = 1/1) | |
| Adjusted to a solid-content of 5% | |

(Example 6)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified acetyl cellulose of Reference example 2 | 32.7 parts |
| Polyisocyanate (Desmodule HL from Bayer Co., Ltd.) | 67.3 parts |
| Solvent (methyl ethyl ketone/toluene = 1/1) | |
| Adjusted to a solid-content of 5% | |

(Comparative Example 1)

Application solution B in Example 1 was not used, but the rest of the procedure was conducted in the same manner as in Example 1 to obtain a thermal transfer material.

(Comparative Example 2)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Hydroxypropylmethyl cellulose of Reference example 1 | 47.5 parts |
| Polyisocyanate (Desmodule HL from Bayer Co., Ltd.) | 52.5 parts |
| Solvent (methyl ethyl ketone/toluene = 1/1) | |
| Adjusted to a solid-content of 5% | |

(Comparative Example 3)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Hydroxypropylmethyl cellulose of Reference example 1 | 35.5 parts |
| Polyisocyanate (Desmodule HL from Bayer Co., Ltd.) | 49.5 parts |
| Amide of higher fatty acid (Famin D86 from Kao Corporation) | 15.0 parts |
| Solvent (methyl ethyl ketone/toluene = 1/1) | |
| Adjusted to a solid-content of 5% | |

(Reference Example 3)

10 g of hydroxypropylmethyl cellulose with 1.11 hydroxyl groups, 1.89 methoxyl groups and 0.24 hydroxypropoxy groups per glucose unit, dried for 2 hours at 105° C., and 0.85 g of dibutyl tin dilaurate were dissolved in 200 ml of dimethylformamide, and heated to 100° C. while being stirred. 25.5 g of organopolysiloxane containing isocyanate, represented by the following general formula:

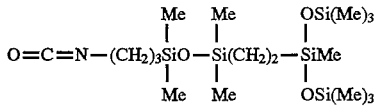

was added to this mixture and 2 hours of stirring at 110°–120° C. was conducted to complete the reaction. After a reprecipitation operation on the reaction solution with 600 ml of water, the precipitate was separated by filtering, repeatedly rinsed with water and n-hexane, and then dried to obtain 24.9 g of silicone modified hydroxypropylmethyl cellulose (silicone content 53.6%).

(Reference Example 4)

Using the same process as Reference example 3, except for the fact that 0.17 g, instead of 0.35 g, of dibutyl tin dilaurate was used and 43.4 g of organopolysiloxane containing isocyanate represented by the following general formula:

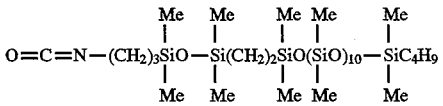

was used, 81.5 g of silicone modified hydroxypropylmethyl cellulose (silicone content 72.2%) was obtained.

(Reference Example 5)

The hydroxypropyl cellulose in Reference example 3 was replaced by 100 g of acetyl cellulose with 0.62 hydroxyl groups and 2.38 acetyl groups per glucose unit, the amount of dibutyl tin dilaurate was changed to 0.07 g, 17.1 g of organopolysiloxane containing isocyanate represented by the following general formula:

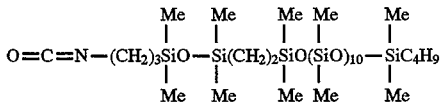

was used, and the rest of the procedure was conducted in the same manner as in Reference example 3 to obtain 24.8 g of silicone modified acetyl cellulose (silicone content 52.5%).

(Example 7)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 3 | 47.5 parts |
| Polyisocyanate (Desmodule HL from Bayer Co., Ltd.) | 52.5 parts |
| Solvent (methyl ethyl ketone/toluene = 1/1) | |
| Adjusted to a solid-content of 5% | |

(Example 8)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 3 | 45.1 parts |
| Polyisocyanate (Desmodule HL from Bayer Co., Ltd.) | 49.9 parts |
| Amide of higher fatty acid (Famin D86 from Kao Corporation) | 5.0 parts |
| Solvent (methyl ethyl ketone/toluene = 1/1) | |
| Adjusted to a solid-content of 5% | |

(Example 9)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 3 | 40.4 parts |
| Polyisocyanate (Desmodule HL from Bayer Co., Ltd.) | 44.6 parts |
| Amide of higher fatty acid (Famin D86 from Kao Corporation) | 15.0 parts |
| Solvent (methyl ethyl ketone/toluene = 1/1) | |
| Adjusted to a solid-content of 5% | |

(Example 10)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 3 | 37.6 parts |
| Polyisocyanate (Desmodule HL from Bayer Co., Ltd.) | 62.4 parts |
| Solvent (methyl ethyl ketone/toluene = 1/1) | |
| Adjusted to a solid-content of 5% | |

(Example 11)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 3 | 95.0 parts |
| Amide of higher fatty acid (Famin D86 from Kao Corporation) | 5.0 parts |
| Solvent (methyl ethyl ketone/toluene = 1/1) | |
| Adjusted to a solid-content of 5% | |

(Example 12)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 4 | 47.5 parts |
| Polyisocyanate (Desmodule HL from Bayer Co., Ltd.) | 52.5 parts |
| Solvent (methyl ethyl ketone/toluene = 1/1) Adjusted to a solid-content of 5% | |

(Example 13)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 5 | 47.5 parts |
| Polyisocyanate (Desmodule HL from Bayer Co., Ltd.) | 52.5 parts |
| Solvent (methyl ethyl ketone/toluene = 1/1) Adjusted to a solid-content of 5% | |

(Comparative Example 4)

Application solution B in Example 1 was replaced by a solution with the following ingredients, and the rest of the procedure was conducted in the same manner as in Example 1 to obtain a thermal transfer material.

| Application solution B: Back coating layer | |
|---|---|
| Silicone modified hydroxypropylmethyl cellulose of Reference example 3 | 22.0 parts |
| Polydimethylsiloxane (100 cs) (silicone content 53.6%) | 25.5 parts |
| Polyisocyanate (Desmodule HL from Bayer Co., Ltd.) | 52.5 parts |
| Solvent (methyl ethyl ketone/toluene = 1/1) Adjusted to a solid-content of 5% | |

Using the thermal transfer materials obtained as described above, the back coating layers were brought in contact with polyethylene terephthalate films with no applied coating and the coefficient of dynamic friction between them was measured using a friction tester (from Toyo Seiki Co., Ltd.) with a load of 200 g and a drawing speed of 150 mm/minute. Also, they were installed on a sublimation type thermal transfer printer and tested to check for the occurrence of heat fusion and contamination of the head. The results are shown in Table 1.

TABLE 1

| | Coefficient of dynamic friction | Heat fusion | Contamination of the head |
|---|---|---|---|
| Examples | | | |
| 1 | 0.28 | None | None |
| 2 | 0.20 | None | None |
| 3 | 0.11 | None | None |
| 4 | 0.17 | None | None |
| 5 | 0.13 | None | None |
| 6 | 0.24 | None | None |

TABLE 1-continued

| | Coefficient of dynamic friction | Heat fusion | Contamination of the head |
|---|---|---|---|
| Comparative examples | | | |
| 1 | 0.45 | Severe fusion | None |
| 2 | 0.38 | Wrinkles | None |
| 3 | 0.19 | None | Severe contamination |
| Examples | | | |
| 7 | 0.20 | None | None |
| 8 | 0.18 | None | None |
| 9 | 0.17 | None | None |
| 10 | 0.22 | None | None |
| 11 | 0.10 | None | None |
| 12 | 0.12 | None | None |
| 13 | 0.15 | None | None |
| Comparative examples | | | |
| 4 | 0.45 | None | Severe Contamination |

(Reference Examples 6–8)

10 parts of each of the silicone modified hydroxypropylmethyl cellulose obtained in Reference examples 1, 3 and 4 was dissolved in a mixed solution of 100 parts of methyl ethyl ketone and 100 parts of toluene to obtain a silicone modified cellulose solution.

(Reference 9)

150 parts of polydimethyl siloxanediol with an average molecular weight of approximately 1,000 represented by the following general formula:

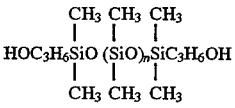

was added, to 250 parts of methyl ethyl ketone, and this mixed solution was loaded in a reactor vessel equipped with a stirrer, a reflux condenser, a dripping funnel, and a gas introduction tube. The content was cooled from outside to have an internal temperature of −5° to 0° C., and carbon dioxide gas was fed through the gas introduction tube while the temperature was kept at this level.

39 parts of hydrogenated MDI (Methylene-bi-(4-phenyl isocyanate)) was then dissolved in 100 parts of methyl ethyl ketone and this solution was dripped into the reactor vessel through the dripping funnel to let the reaction take place. After the dripping was completed, the internal temperature was gradually raised to 50° C. and the content was stirred for 1 hour at 50° C. to obtain a polyurethane resin solution containing siloxane bonds.

(Reference 10)

50 parts of polyvinyl butyral (degree of polymerization: 1,700, hydroxyl group content: 33 mole %) was dissolved in 500 parts of an equal-amount mixed solvent of methyl ethyl ketone and toluene, and 10 parts of polysiloxane (molecular weight: 3,000) represented by the following general formula:

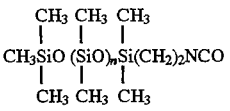

was gradually dripped into this solution, followed by a 5-hour reaction at 60° C., to obtain a polyvinyl butyral resin solution containing siloxane segments.

(Reference Example 11)

30 parts of the hydroxypropylmethyl cellulose used in Reference example 1, 20 parts of siloxane diol (average molecular weight: 5,600) represented by the following general formula:

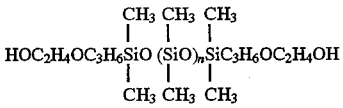

and 50 parts of polyisocyanate (product name "Desmodule H"L from Bayer Co., Ltd.) were dissolved in 900 parts of an equal-amount mixed solvent of methyl ethyl ketone and toluene to obtain a polysiloxane-containing cross-linked cellulose resin solution.

(Examples 14–16, Comparative Examples 5–7)

A back coating layers was formed on 4.5 micrometer-thick polyethylene terephthalate films using each of the resin solutions obtained in Reference examples 3–6 described above, and evaluations were conducted for the slip properties, heat resistance and abrasion resistance. The slip properties were evaluated using the coefficient of dynamic friction in the same manner as in Examples 1–6. The heat resistance was evaluated using Tg (Glass transition temperature) measured with a DSC (Differential Scanning Calorimetry) (product name "TA4000" from Metler Co., Ltd.). The abrasion resistance was evaluated based on whether or not the thermal head was contaminated, in the same manner as in Examples 1–6. The results are shown in Table 2.

TABLE 2

| | Resin Solution | Coefficient of dynamic friction | Tg (°C.) | Contamination of the head |
|---|---|---|---|---|
| Examples | | | | |
| 14 | Reference example 6 | 0.29 | 88 | None |
| 15 | Reference example 7 | 0.23 | 85 | None |
| 16 | Reference example 8 | 0.16 | 82 | None |
| Comparative examples | | | | |
| 5 | Reference example 9 | 0.24 | 56 | None |
| 6 | Reference example 10 | 0.35 | 95 | None |
| 7 | Reference example 11 | 0.22 | 100 or more | Contaminated |

In general, it is believed that a good back coating layer must meet the following conditions:

Slip properties: Coefficient of dynamic friction ≦0.30

Heat resistance: Tg≧80° C.

Friction resistance: No contamination on the thermal head

As clearly shown in Table 2, Examples 14–16 meet all of the above conditions and are preferable as back coating layers. On the other hand, Comparative example 5 had insufficient heat resistance, Comparative example 6 had insufficient slip properties and Comparative example 7 had insufficient abrasion resistance.

What is claimed is:

1. A thermal transfer material comprising a base film having on one side a thermal transfer pigment layer and on the other side a back coating layer comprising a reaction product of one or more polysaccharide derivative(s) with an organopolysiloxane represented by:

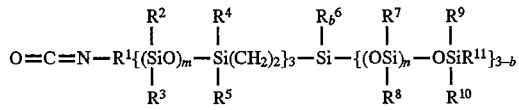

wherein $R^1$ denotes a divalent hydrocarbon group with 1–10 carbon atoms, each group of $R^2$–$R^8$ denotes a monovalent hydrocarbon group with 1–10 carbon atoms, each group of $R^9$–$R^{11}$ denotes a monovalent hydrocarbon group with 1–10 carbon atoms or a triorganosiloxy group represented by —$OSiR^{12}R^{13}R^{14}$, each group of $R^{12}$, $R^{13}$ and $R^{14}$ denote a monovalent hydrocarbon group with 1–10 carbon atoms, "m" denotes an integer 0–5, "n" denotes an integer 0–200, "a" denotes 0 or 1, and "b" denotes 0, 1 or 2; or said reaction product which has been cured by cross-linking with polyisocyanate.

2. A thermal transfer material according to claim 1, wherein said organopolysiloxane is represented by:

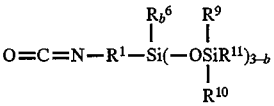

wherein $R^1$ denotes a divalent hydrocarbon group with 1–10 carbon atoms, $R^6$ denotes a monovalent hydrocarbon group with 1–10 carbon atoms, each group of $R^9$–$R^{11}$ denotes a monovalent hydrocarbon group with 1–10 carbon atoms or a triorganosiloxy group represented by —$OSiR^{12}R^{13}R^{14}$, each group of $R^{12}$, $R^{13}$ and $R^{14}$ denotes a monovalent hydrocarbon group with 1–10 carbon atoms, and "b" denotes 0, 1 or 2.

3. A thermal transfer material according to claim 1 wherein said organopolysiloxane is represented by:

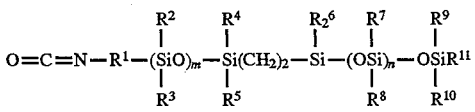

wherein $R^1$ denotes a divalent hydrocarbon group with 1–10 carbon atoms, each group of $R^2$–$R^8$ denotes a monovalent hydrocarbon group with 1–10 carbon atoms, each group of $R^9$–$R^{11}$ denotes a monovalent hydrocarbon group with 1–10 carbon atoms or a triorganosiloxy group represented by —$OSiR^{12}R^{13}R^{14}$, each group of $R^{12}$, $R^{13}$ and $R^{14}$ denotes a monovalent hydrocarbon group with 1–10 carbon atoms, "m" denotes an integer 0–5, and "n" denotes an integer 0–200.

4. A thermal transfer material according to claim 1 wherein said organopolysiloxane is represented by:

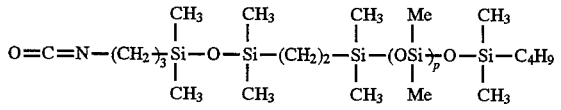

wherein "p" denotes an integer 10–60.

5. A thermal transfer material according to claim 1 wherein said organopolysiloxane is represented by:

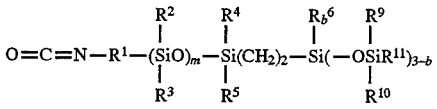

wherein $R^1$ denotes a divalent hydrocarbon group with 1–10 carbon atoms, each group of $R^2$–$R^8$ denotes a monovalent hydrocarbon group with 1–10 carbon atoms, each group of $R^9$–$R^{11}$ denotes a monovalent hydrocarbon group with 1–10 carbon atoms or a triorganosiloxy group represented by —$OSiR^{12}R^{13}R^{14}$, each group of $R^{12}$, $R^{13}$ and $R^{14}$ denotes monovalent hydrocarbon group with 1–10 carbon atoms, "m" denotes an integer 0–5, and "b" denotes 0, 1 or 2.

6. A thermal transfer material according to claim 1 wherein said one or more polysaccharide derivative(s) are one derivative or a mixture of more than one different derivative selected from the group consisting of methyl cellulose, ethyl cellulose, hydroxypropylmethyl cellulose, hydroxyethyl cellulose, hydroxyethylmethyl cellulose, acetyl cellulose, acetyl cellulose butyrate, starch, dextrine and pullulan.

7. A thermal transfer material according to claim 1 wherein the cured product is prepared by cross-linking more than one polysaccharide derivative(s) using polyisocyanate.

* * * * *